US008640415B2

(12) United States Patent
Pilz et al.

(10) Patent No.: US 8,640,415 B2
(45) Date of Patent: Feb. 4, 2014

(54) FIRE-RATED WALL CONSTRUCTION PRODUCT

(75) Inventors: Don A. Pilz, Livermore, CA (US); Raymond E. Poliquin, City of Industry, CA (US); Fernando Hernandez Sesma, City of Industry, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 129 days.

(21) Appl. No.: 13/083,328

(22) Filed: Apr. 8, 2011

(65) Prior Publication Data

US 2011/0247281 A1 Oct. 13, 2011

Related U.S. Application Data

(60) Provisional application No. 61/322,222, filed on Apr. 8, 2010.

(51) Int. Cl.
*E04C 2/34* (2006.01)

(52) U.S. Cl.
USPC ..... 52/481.1; 52/232; 52/483.1

(58) Field of Classification Search
USPC ..... 52/232, 481.1, 483.1, 831
See application file for complete search history.

(56) References Cited

U.S. PATENT DOCUMENTS

| | | | |
|---|---|---|---|
| 1,130,722 | A | 3/1915 | Fletcher |
| 1,563,651 | A | 12/1925 | Pomerantz |
| 2,218,426 | A | 10/1940 | Hulbert, Jr. |
| 2,683,927 | A | 7/1954 | Maronek |
| 2,733,786 | A | 2/1956 | Drake |
| 3,129,792 | A | 4/1964 | Gwynne |
| 3,324,615 | A | 6/1967 | Zinn |
| 3,397,495 | A | 8/1968 | Thompson |
| 3,481,090 | A | 12/1969 | Lizee |
| 3,537,219 | A | 11/1970 | Navarre |
| 3,566,559 | A | 3/1971 | Dickson |
| 3,744,199 | A | 7/1973 | Navarre |
| 3,786,604 | A | 1/1974 | Kramer |
| 3,839,839 | A | 10/1974 | Tillisch et al. |
| 3,908,328 | A | 9/1975 | Nelsson |
| 3,935,681 | A | 2/1976 | Voiturier et al. |

(Continued)

FOREIGN PATENT DOCUMENTS

| | | |
|---|---|---|
| CA | 2234347 | 10/1999 |
| EP | 0346126 | 12/1989 |

(Continued)

OTHER PUBLICATIONS

Canadian First Office Action for Application No. 2,697,295, dated Sep. 21, 2011, in 4 pages.

(Continued)

*Primary Examiner* — Brent W Herring
(74) *Attorney, Agent, or Firm* — Knobbe Martens Olson & Bear

(57) ABSTRACT

The present application is directed toward fire-rated wall construction components and wall systems for use in building construction. Embodiments can include tracks for holding studs which incorporate various geometries capable of receiving fire-retardant material, including but not limited to intumescent material. The fire-retardant material can be attached to the tracks such that the fire-retardant material expands and seals gaps and/or areas between the tracks and wall components such as ceilings, floors, and drywall.

15 Claims, 8 Drawing Sheets

(56) References Cited

U.S. PATENT DOCUMENTS 3,955,330 A 5/1976 Wendt
3,964,214 A 6/1976 Wendt
3,974,607 A 8/1976 Balinski
4,011,704 A 3/1977 O'Konski
4,103,463 A 8/1978 Dixon
4,130,972 A 12/1978 Varlonga
4,144,335 A 3/1979 Edwards
4,144,385 A 3/1979 Downing
4,152,878 A 5/1979 Balinski
4,164,107 A 8/1979 Kraemling et al.
4,178,728 A 12/1979 Ortmanns et al.
4,203,264 A 5/1980 Kiefer et al.
4,283,892 A 8/1981 Brown
4,318,253 A 3/1982 Wedel
4,329,820 A 5/1982 Wendt
4,424,653 A 1/1984 Heinen
4,437,274 A 3/1984 Slocum et al.
4,649,089 A 3/1987 Thwaites
4,672,785 A 6/1987 Salvo
4,709,517 A 12/1987 Mitchell et al.
4,723,385 A 2/1988 Kallstrom
4,787,767 A 11/1988 Wendt
4,825,610 A 5/1989 Gasteiger
4,850,385 A 7/1989 Harbeke
4,885,884 A 12/1989 Schilger
4,918,761 A 4/1990 Harbeke
4,930,276 A 6/1990 Bawa et al.
5,010,702 A 4/1991 Daw et al.
5,094,780 A 3/1992 von Bonin
5,103,589 A 4/1992 Crawford
5,125,203 A 6/1992 Daw
5,127,203 A 7/1992 Paquette
5,127,760 A 7/1992 Brady
5,146,723 A 9/1992 Greenwood et al.
5,155,957 A 10/1992 Robertson et al.
5,157,883 A 10/1992 Meyer
5,167,876 A 12/1992 Lem
5,173,515 A 12/1992 von Bonin et al.
5,222,335 A 6/1993 Petrecca
5,244,709 A 9/1993 Vanderstukken
5,285,615 A 2/1994 Gilmour
5,325,651 A 7/1994 Meyer et al.
5,347,780 A 9/1994 Richards et al.
5,367,850 A 11/1994 Nicholas
5,374,036 A 12/1994 Rogers et al.
5,390,465 A 2/1995 Rajecki
5,394,665 A 3/1995 Johnson
5,412,919 A 5/1995 Pellock et al.
5,452,551 A 9/1995 Charland et al.
5,456,050 A 10/1995 Ward
5,471,805 A 12/1995 Becker
5,552,185 A 9/1996 De Keyser
5,592,796 A 1/1997 Landers
5,604,024 A 2/1997 von Bonin
5,644,877 A 7/1997 Wood
5,687,538 A 11/1997 Frobosilo et al.
5,689,922 A 11/1997 Daudet
5,709,821 A 1/1998 von Bonin et al.
5,755,066 A 5/1998 Becker
5,787,651 A 8/1998 Horn et al.
5,797,233 A 8/1998 Hascall
5,806,261 A 9/1998 Huebner et al.
5,913,788 A * 6/1999 Herren ..... 52/241
5,921,041 A 7/1999 Egri, II
5,927,041 A 7/1999 Sedlmeier et al.
5,930,963 A 8/1999 Nichols
5,950,385 A * 9/1999 Herren ..... 52/481.1
5,968,669 A 10/1999 Liu et al.
6,058,668 A 5/2000 Herron
6,110,559 A 8/2000 De Keyser
6,151,858 A 11/2000 Ruiz et al.
6,176,053 B1 1/2001 St. Germain
6,182,407 B1 * 2/2001 Turpin et al. ..... 52/232
6,189,277 B1 2/2001 Boscamp
6,207,077 B1 3/2001 Burnell-Jones
6,207,085 B1 3/2001 Ackerman
6,213,679 B1 4/2001 Frobosilo et al.
6,216,404 B1 4/2001 Vellrath
6,233,888 B1 5/2001 Wu
6,305,133 B1 10/2001 Cornwall
6,374,558 B1 * 4/2002 Surowiecki ..... 52/241
6,405,502 B1 6/2002 Cornwall
6,430,881 B1 8/2002 Daudet et al.
6,470,638 B1 10/2002 Larson
6,647,691 B2 11/2003 Becker et al.
6,679,015 B1 1/2004 Cornwall
6,705,047 B2 3/2004 Yulkowski
6,732,481 B2 5/2004 Stahl, Sr.
6,783,345 B2 8/2004 Morgan et al.
6,799,404 B2 10/2004 Spransy
6,843,035 B1 1/2005 Glynn
6,854,237 B2 2/2005 Surowiecki
6,871,470 B1 * 3/2005 Stover ..... 52/648.1
7,043,880 B2 5/2006 Morgan et al.
7,059,092 B2 * 6/2006 Harkins et al. ..... 52/232
7,152,385 B2 12/2006 Morgan et al.
7,191,845 B2 3/2007 Loar
7,240,905 B1 7/2007 Stahl
7,302,776 B2 12/2007 Duncan et al.
7,487,591 B2 * 2/2009 Harkins et al. ..... 29/897.312
7,506,478 B2 3/2009 Bobenhausen
7,540,118 B2 6/2009 Jensen
7,617,643 B2 11/2009 Pilz et al.
7,681,365 B2 * 3/2010 Klein ..... 52/232
7,752,817 B2 * 7/2010 Pilz et al. ..... 52/207
7,775,006 B2 8/2010 Giannos
7,776,170 B2 8/2010 Yu et al.
7,814,718 B2 * 10/2010 Klein ..... 52/232
7,827,738 B2 11/2010 Abrams et al.
7,866,108 B2 * 1/2011 Klein ..... 52/483.1
7,950,198 B2 5/2011 Pilz et al.
8,056,293 B2 * 11/2011 Klein ..... 52/483.1
8,061,099 B2 * 11/2011 Andrews ..... 52/483.1
8,069,625 B2 * 12/2011 Harkins et al. ..... 52/232
8,074,416 B2 * 12/2011 Andrews ..... 52/241
8,087,205 B2 * 1/2012 Pilz et al. ..... 52/232
8,100,164 B2 * 1/2012 Goodman et al. ..... 160/199
8,132,376 B2 * 3/2012 Pilz et al. ..... 52/207
8,136,314 B2 * 3/2012 Klein ..... 52/232
8,151,526 B2 * 4/2012 Klein ..... 52/232
8,181,404 B2 * 5/2012 Klein ..... 52/232
8,225,581 B2 * 7/2012 Strickland et al. ..... 52/850
8,281,552 B2 10/2012 Pilz et al.
8,322,094 B2 12/2012 Pilz et al.
2002/0170249 A1 11/2002 Yulkowski
2003/0079425 A1 5/2003 Morgan et al.
2003/0089062 A1 5/2003 Morgan et al.
2003/0213211 A1 11/2003 Morgan et al.
2004/0010998 A1 1/2004 Turco
2004/0016191 A1 * 1/2004 Whitty ..... 52/232
2004/0045234 A1 3/2004 Morgan et al.
2004/0139684 A1 7/2004 Menendez
2004/0211150 A1 10/2004 Bobenhausen
2005/0246973 A1 11/2005 Jensen
2006/0032163 A1 2/2006 Korn
2006/0123723 A1 6/2006 Weir et al.
2006/0137293 A1 6/2006 Klein
2007/0056245 A1 3/2007 Edmondson
2007/0068101 A1 3/2007 Weir et al.
2007/0193202 A1 * 8/2007 Rice ..... 52/733.2
2007/0261343 A1 11/2007 Stahl, Sr.
2008/0087366 A1 4/2008 Yu et al.
2008/0134589 A1 6/2008 Abrams et al.
2008/0172967 A1 7/2008 Hilburn
2008/0250738 A1 10/2008 Howchin
2009/0038764 A1 * 2/2009 Pilz ..... 160/194
2009/0049781 A1 2/2009 Pilz et al.
2009/0090074 A1 4/2009 Klein
2009/0094912 A1 4/2009 Klein
2009/0178363 A1 7/2009 Pilz et al.
2009/0178369 A1 7/2009 Pilz et al.
2010/0126092 A1 5/2010 Pilz et al.
2010/0170172 A1 7/2010 Klein
2011/0113709 A1 5/2011 Pilz et al.

(56) References Cited

U.S. PATENT DOCUMENTS

| | | | |
|---|---|---|---|
| 2011/0185656 | A1 | 8/2011 | Klein |
| 2011/0214371 | A1 | 9/2011 | Klein |
| 2011/0247281 | A1 | 10/2011 | Pilz et al. |
| 2012/0066989 | A1 | 3/2012 | Pilz et al. |

FOREIGN PATENT DOCUMENTS

| | | |
|---|---|---|
| GB | 2159051 | 11/1985 |
| GB | 2411212 | 8/2005 |
| JP | 06146433 | 5/1994 |
| JP | 06220934 | 8/1994 |
| WO | WO 03/038206 | 5/2003 |
| WO | WO 2007/103331 | 9/2007 |
| WO | WO 2009/026464 | 2/2009 |

OTHER PUBLICATIONS

Canadian First Office Action for Application No. 2,697,295, dated May 23, 2012, in 4 pages.

Information Disclosure Statement letter, dated Aug. 4, 2011.

Catalog page from Stockton Products, printed from www.stocktonproducts.com, on Dec. 16, 2007, showing #5 Drip, in 1 page.

International Search Report for Application No. PCT/US2008/073920, dated Apr. 9, 2009.

* cited by examiner

FIRE-RATED WALL CONSTRUCTION PRODUCT

RELATED APPLICATIONS

This application claims benefit under 35 U.S.C. §119(e) to U.S. Provisional Patent Application No. 61/322,222, filed Apr. 8, 2010.

INCORPORATION BY REFERENCE

U.S. Provisional Patent Application No. 61/322,222, filed Apr. 8, 2010, is incorporated in its entirety by reference herein. The entireties of U.S. Pat. No. 7,617,643, U.S. Patent Publication No. 2009/0049781, U.S. Patent Publication No. 2009/0038764, U.S. Patent Publication No. 2009/0178363, and U.S. Patent Publication No. 2009/0178369 are each incorporated by reference herein.

BACKGROUND OF THE INVENTION

1. Field of the Invention

This application is directed toward fire-rated wall construction components for use in building construction.

2. Description of the Related Art

Header tracks, including slotted header tracks, are commonly used in the construction industry as a portion of a wall assembly. A typical header track resembles a generally U-shaped (or some other similarly shaped) elongated channel capable of receiving or covering the ends of wall studs and holding the wall studs in place. The header track also permits the wall assembly to be coupled to an upper horizontal support structure, such as a ceiling, floor of a higher level floor of a multi-level building, or a support beam.

Header tracks generally have a web and at least one flange extending from the web. Typically, the header track includes a pair of flanges, which extend in the same direction from opposing edges of the web. Along the flanges of the slotted tracks generally is a plurality of slots. When the wall studs are placed into a slotted track, the plurality of slots accommodates fasteners to permit attachment of the wall studs to the slotted track. The slots allow the wall studs to move generally orthogonally relative to the track. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move. Even in locations in which earthquakes are not common, movement between the studs and the header track can be desirable to accommodate movement of the building structure due to other loads, such as stationary or moving overhead loads, for example.

Fire-rated wall construction components and assemblies are also commonly used in the construction industry. These components and assemblies are aimed at preventing fire, heat, and smoke from leaving one portion of a building or room and entering another, usually through vents, joints in walls, or other openings. The components often incorporate fire-retardant materials which substantially block the path of the fire, heat, or smoke for at least some period of time. Intumescent materials work well for this purpose, since they swell and char when exposed to flames, helping to create a barrier to the fire, heat, and/or smoke.

One example of a fire-rated wall construction component is a head-of-wall fire block device sold under the trademark Firestik®. The Firestik® fire block product incorporates a metal profile with a layer of intumescent material on its inner surface. The metal profile of the Firestik® fire block product is independently and rigidly attached to a wall component, such as the bottom of a floor or ceiling, and placed adjacent to the gap between the wallboard (e.g., drywall) and the ceiling. The intumescent material, which is adhered to the inner surface of the metal profile, faces the wallboard, stud and header track. The space created in between the wallboard and ceiling, and the space between the stud and header track, allows for independent vertical movement of the stud in the header track when no fire is present.

When temperatures rise, the intumescent material on the Firestik® fire block product expands rapidly. This expansion creates a barrier which fills the head-of-wall gap and substantially inhibits or at least substantially prevents fire, heat, and smoke from moving through the spaces around the stud and track and entering an adjacent room for at least some period of time.

SUMMARY OF THE INVENTION

An aspect of at least one of the embodiments disclosed herein includes the realization that it would be desirable to have a fire-retardant wall system that includes a header track incorporating a fire-retardant material directly on the header track. Moreover, an aspect of at least one of the embodiments disclosed herein includes the realization that it would be desirable to configure the header track to inhibit or at least substantially prevent the passage of air through a head-of-wall gap in conditions prior to any expansion of a heat-activated expandable fire-retardant material or prior to complete expansion or expansion of the heat-activated expandable fire-retardant material sufficient enough to close the head-of-wall gap.

Another aspect of at least one of the embodiments disclosed herein includes the realization that current fire-retardant wall systems often fail to adequately seal the head-of-wall gaps that form between pieces of wallboard (e.g., drywall) and the header track, and/or between a ceiling or floor deck and the header track. Therefore, it would be beneficial to have a fire-retardant wall system that is able to seal areas between the drywall and header tracks, as well as areas between the header tracks and other wall components such as the ceiling and floor decks, without resorting to applying fire-retardant sealant after drywall assembly.

A preferred embodiment involves a fire-retardant wall system, including a horizontal ceiling element, a plurality of vertical wall studs and a header track for receiving the wall studs. The track is connected to the horizontal ceiling element and includes a web and at least one flange. The flange extends from the web and has a first planar portion and a second planar portion, the first planar portion being proximal compared to the distal second planar portion relative to the web. At least one surface on the web is adapted to accept a fire-retardant material strip thereon and at least a first fire-retardant material strip is attached to the at least one surface on the web. The fire-retardant material strip is configured to expand when exposed to elevated heat. The first fire-retardant material strip is positioned between and contacts both the web and the horizontal ceiling element to create at least a substantial seal inhibiting the passage of air from one side of the track to the other side of the track through a gap between the horizontal ceiling element and the web when the fire-retardant material strip is in an unexpanded state. At least one piece of wallboard is supported by the wall studs. The wallboard is in direct contact with the first planar portion of the flange. The second planar portion of the flange is recessed inwardly from the first portion, such that the wallboard is not in direct contact with the second portion.

In some embodiments, the first fire-retardant material strip is positioned at a corner between the web and the at least one flange. The first fire-retardant material strip can extend outwardly beyond the corner such that an outermost edge of the first fire-retardant material strip is spaced outwardly of the first planar portion of the at least one flange. The web can define a recess and the first fire-retardant material strip can be positioned in the recess. Some embodiments may include a plurality of fasteners, wherein each one of the plurality of fasteners attach one of the plurality of studs to the track. The plurality of fasteners can be located within the second planar portion of the at least one flange. A plurality of vertical slots can be formed within the second planar portion and spaced along a length of the track, wherein each one of the plurality of fasteners is passed through one of the plurality of vertical slots. A second fire-retardant material strip can be positioned on an interior surface of the first planar portion.

Another preferred embodiment involves a fire-retardant wall system, including a horizontal ceiling element, a plurality of vertical wall studs, and a header track for receiving the wall studs. The track is connected to the horizontal ceiling element and includes a web and at least one flange. The at least one flange extends from the web and has a free end opposite the web. The at least one flange defines, relative to the web, a proximal portion and a distal portion. The distal portion contains the free end. The proximal portion defines a first outer surface portion and a second outer surface portion. The first and second outer surface portions are spaced from one another and define a recess therebetween. Each one of a plurality of fasteners secures one of the plurality of studs to the track. The plurality of fasteners passes through the distal portion of the at least one flange. A fire-retardant material strip is positioned within the recess and is configured to expand when exposed to elevated heat. At least one piece of wallboard is supported by the wall studs. The wallboard contacts at least one of the first and second outer surface portions and covers at least a portion of the fire-retardant material strip.

In some embodiments, at least one of the first and second outer surface portions is defined by an elongate rib extending along the flange. The proximal portion of the at least one flange further can includes a planar surface portion which defines the first outer surface portion, and wherein the second outer surface portion is defined by the elongate rib. The proximal portion of the at least one flange further can include a planar surface portion which defines at least one of the first and second outer surface portions. At least one web fire-retardant material strip can be secured to the web of the track. The at least one web fire-retardant material strip can be positioned at a corner between the web and the at least one flange. The web fire-retardant material strip can extend outwardly beyond the corner such that an outermost edge of the web fire-retardant material strip is spaced outwardly of the first and second outer surface portions of the at least one flange. The web can define a recess and the web fire-retardant material strip can be positioned in the recess. A plurality of vertical slots can be formed within the distal portion and spaced along a length of the track, wherein each one of the plurality of fasteners is passed through one of the plurality of vertical slots.

Still another preferred embodiment involves a header track adapted for use in a fire-retardant wall system. The header track includes a web portion, a first flange and a second flange extending in the same direction from opposing side edges of the web portion. The header track defines an exterior surface and an interior surface. Each of the first flange and the second flange has a planar proximal portion and a planar distal portion, the proximal portion being closer to the web than the distal portion and the distal portion containing a free end of a respective one of the first and second flanges. A first distance is defined between the proximal portions of the first and second flanges and a second distance is defined between the distal portions of the first and second flanges. The first and second distances are taken in a direction substantially parallel to the web and perpendicular to the side edges of the web. The first distance is greater than the second distance. At least one fire-retardant material strip secured to a surface of the header track.

In some embodiments, the at least one fire-retardant material strip can be secured to an interior surface of the proximal portion of one of the first and second flanges. In some embodiments, the at least one fire-retardant material strip can secured to the web portion. The at least one fire-retardant material strip can include a first strip and a second strip, wherein the first strip can be secured to an interior surface of the proximal portion of one of the first and second flanges and the second strip can be secured to the web portion.

A preferred embodiment involves a track adapted for use in a fire-retardant wall system. The track includes a web portion, a first flange and a second flange extending in the same direction from opposing side edges of the web portion and spaced from one another a sufficient distance to receive and end of a wall stud therebetween. The track defines an exterior surface and an interior surface. At least one of the web portion, first flange and second flange include a plurality of openings extending therethrough. At least one fire-retardant material strip is secured to a surface of the track such that it covers at least a portion of each of the plurality of openings. In some arrangements, the openings and fire-retardant material strip are provided on one or both of the flanges. In some arrangements, the fire-retardant material strip covers an entirety of each of the openings.

Preferred embodiments also include the individual components of the described wall system and wall systems including the described components. Components described herein, whether individually or in the context of a wall system, can be mixed and matched along with other known components to create a variety of different wall systems. Preferred embodiments also include method of manufacturing wall system components described herein, including but not limited to header tracks, and methods of assembling the wall systems disclosed herein or other wall systems utilizing components disclosed herein.

Another preferred embodiment is a generally C-shaped or U-shaped header track having an interior surface and an exterior surface, with at least one strip of fire-retardant or intumescent material secured to the interior surface. Yet another preferred embodiment is a header track having a web and at least one flange, with a corner defined between the web and the flange and a strip of fire-retardant or intumescent material secured to the web and that extends outwardly beyond the corner. Still another preferred embodiment is a header track having a web and at least one flange, wherein the flange defines a pair of projecting or outer surface portions and a strip of intumescent or fire-retarding material is secured to the flange between the projecting or outer surface portions.

The present application describes numerous embodiments of fire-rated wall construction components and systems for use in building construction. The term "wall," as used herein, is a broad term, and is used in accordance with its ordinary meaning. The term may include, but is not limited to, vertical walls, ceilings, and floors.

BRIEF DESCRIPTION OF THE DRAWINGS

These and other features, aspects and advantages of the various devices, systems and methods presented herein are described with reference to drawings of certain embodiments, which are intended to illustrate, but not to limit, such devices, systems, and methods. It is to be understood that the attached drawings are for the purpose of illustrating concepts of the embodiments discussed herein and may not be to scale.

DETAILED DESCRIPTION OF THE PREFERRED EMBODIMENTS

Figure 1:
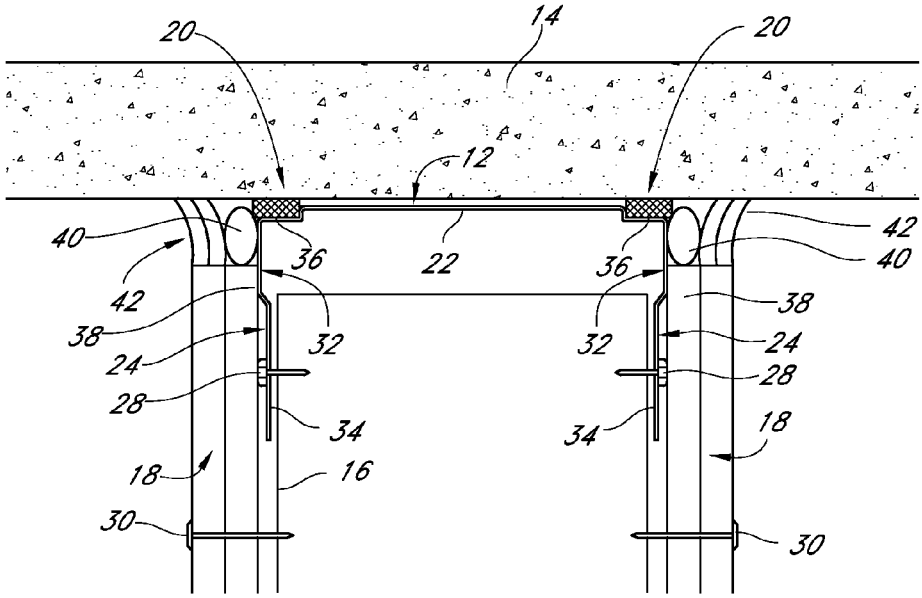
FIG. 1 illustrates a cross-sectional view of an embodiment of a fire-rated wall system, including a header track with fire-retardant material applied thereon.

Several embodiments of an improved fire-rated wall system 10 and individual components of the wall system 10 are disclosed herein. The embodiments disclosed herein often are described in the context of a wall system 10 for use in the interior of a building and configured for preventing passage of smoke and/or fire between adjacent rooms in an elevated-temperature environment. The system 10 can include, for example, a metal header track and at least one metal stud nested within the track, with at least one layer of fire-retardant material applied on the header track. However, the embodiments herein can be applied to wall systems configured for other types of environments as well, such as for exterior wall applications, and can include different and/or additional components and types of materials other than those described herein.

For the purpose of providing context to the present disclosure, it is noted that in 2006 a revision was made to Underwriters Laboratory UL 2079 "Test for Fire Resistance of Building Joints". The revision recommended a new test to determine the amount of air or smoke that can pass through a wall joint (e.g. the area or gap generally between the top of a wallboard and a ceiling component in a fire rated framed wall) in both an ambient condition, as well as at 400 degrees Fahrenheit (F). It had been determined that smoke is as dangerous, or more dangerous, than flames in a fire event. Thus, there was a desire to begin testing for movement of smoke through wall joints. Specifically, there was a desire to test for two vulnerable points or locations in a wall assembly where air or smoke can pass from one room to another. The first of these points or locations is at the intersection between the top header track and the ceiling element (e.g., the ceiling deck or floor deck of the floor above). The second point or location is at the intersection between top header track and the drywall, where a deflection gap is often located. Maintaining a consistent air tight seal of these two points or locations is thus required for passing all components of the UL 2079 test.

However, this new test has since proven to be problematic for some building components because of certain characteristics of current building products and assembly methods. For example, drywall gypsum board is the most common product used in fire rated framed walls. The typical size for drywall gypsum board is 4'×8' sheets. The drywall can lay relatively flat when up against a flat substrate (e.g., a framed wall). However, if there is any type of protrusion in the substrate, that protrusion can transfer through the drywall, creating a hump or a gap on the other side of the drywall. If the protrusion is around the perimeter of the sheet of drywall, the protrusion can often create a separation gap between the framed wall substrate and the edge of the drywall.

As described above, metal stud framing (e.g. use of a header and/or footer track to hold metal studs) is a very common component of fire-rated framed wall construction. This type of framing can consist of a U-shaped or generally U-shaped track to receive a C-shaped or generally C-shaped stud. The tracks are generally placed along both a floor and a ceiling element, with studs nested into the tracks, one end of each stud nested in a track along the floor, and the other end of each stud nested in a track along the ceiling. In order for the stud to nest into the track, the outside dimension of the stud can be the same as the inside dimension of the track. However, by virtue of the thickness of the steel forming a track, this can often create a slight offset between the track and the drywall, because the drywall can extend along both the track and the stud extending below or above the track. Furthermore, a fastening screw is often used to attach the stud to the track. This additional protrusion or obstacle, combined with the offset described above, can for example create up to a ⅛" or greater gap between portions the framed wall and the sheet of drywall.

To conceal these gaps, and particularly to seal these gaps in joint areas (e.g. between the top a header track and ceiling element and/or between a stud and drywall near the header track) most fire-rated wall systems attempt to utilize fire resistant sealant. But this has proven to be difficult in many conditions, because the fire resistant sealant is applied after the drywall installation. By the time the drywall is installed over the framed wall, much of the mechanical equipment can already be in place, making it difficult to access and apply the fire resistant sealant over the joints located at the top of wall. Also adding to the problem is the limited working space often caused by mechanical equipment that is typically as close to the ceiling element as possible.

Furthermore, these wall joints can also be difficult for inspectors to see and evaluate whether or not the joint was properly treated for a fire-rated condition. Because of this, inspectors have often become creative in the way they perform their inspections, using small mirrors on the end of an expandable steel rod or probes that can bend around obstructions and take a photograph of the wall joint and fire-retardant sealant. This only illustrates how difficult it can be to properly treat a joint area for fire and smoke protection after drywall installation. This difficulty can be avoided if the fire and smoke protection is done during the initial wall framing. One or more embodiments disclosed herein provide fire and/or smoke protection elements on a framing member (e.g., the header or footer track) such that the fire and/or smoke protection can be completely or at least partially installed during the wall framing process.

Figure 2:
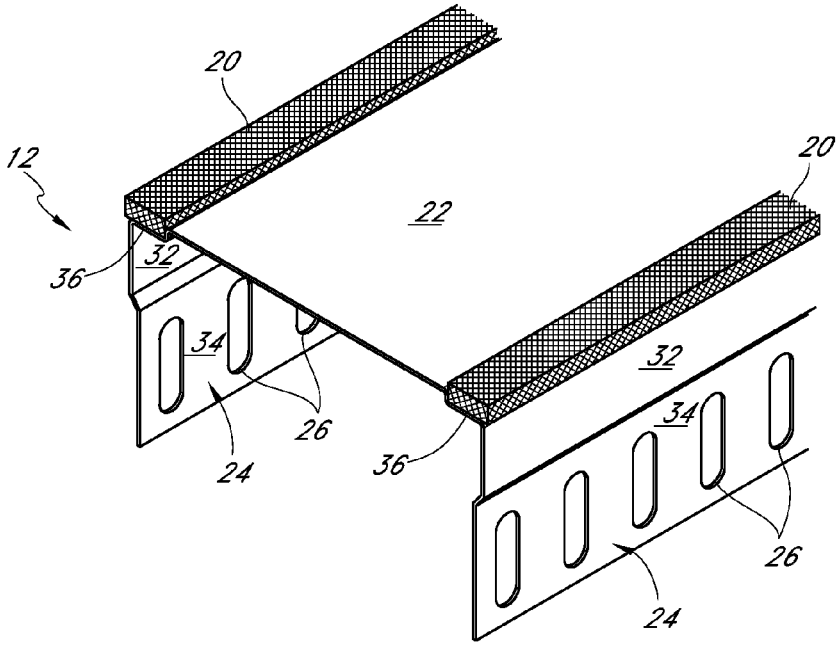
FIG. 2 illustrates a perspective view of the header track of FIG. 1 separate from the other components of the wall system.

With reference to FIGS. 1 and 2, a wall system 10 can comprise a header track 12, a ceiling element 14, one or more studs 16, and at least one piece of wall board or drywall 18. The header track 12 can comprise, for example, an elongate generally U-shaped piece of light gauge steel, or other metal, for receiving a stud or studs 16, though other shapes are also possible. The header tracks disclosed herein preferably are constructed from a unitary, elongate piece of metal that is bent along its length into a desired cross-sectional shape. Preferably, the header tracks have a constant or substantially constant wall thickness throughout its cross-section and length. Roll-forming or other suitable manufacturing methods may be used. The ceiling element 14 can comprise, for example, a concrete slab, drywall, or concrete pan deck, each of which is commonly used in high rise building construction. Thus, "ceiling element" is a broad term used in its ordinary meaning to include overhead horizontal structures to which a header track is normally attached. The stud 16 can comprise, for example, a generally U-shaped or C-shaped light gauge metal stud commonly used in commercial building construction. The wall board or drywall 18 can comprise, for example, a common gypsum drywall board.

The track 12 can include, or can be configured to receive, at least one layer of fire-retardant material 20. The fire-retardant material 20 can include paint, intumescent tape, cured sealant, and/or any other suitable types of fire-retardant material. For example, the tracks 12 can include strips of BlazeSeal™ intumescent tape available from the RectorSeal® Corporation of Houston, Tex., or other suitable intumescent materials used in the industry. The intumescent tape can expand up to 35 times its original size when introduced to heat levels above 370 degrees Fahrenheit caused by fire.

The fire-retardant material 20 can be applied (e.g. by adhesion) in the factory or on-site to the header track 12, such that the fire-retardant material 20 remains in contact with the header track 12 when the header track 12 is exposed to elevated levels of heat. The fire-retardant material 20, once expanded, can substantially or completely inhibit smoke or fire passage through a wall joint.

The term "wall joint," as used herein, generally includes any area of connection and/or gap defined between a first wall system component, such as the top header track 12 or drywall 18, and another wall system component, such as the ceiling element 14. In particular, the term "wall joint" used herein primarily refers to the gaps and/or connections formed between ceiling elements 14 and header tracks 12, between ceiling elements 14 and drywalls 18, and/or between header tracks 12 and drywalls 18, but may extend to other joints as well.

With continued reference to FIGS. 1 and 2, the track 12 can comprise a web 22 and two flanges 24 extending from opposite sides of the web 22. The flanges 24 can include slots 26 to accommodate relative movement (e.g. vertical) between the studs 16 and track 12. The slots 26 can provide an attachment point between the stud 16 and track 12. Fasteners 28, such as for example metal screws, can be used to attach the track 12 to the stud 16 through the slots 26. The fastener is typically positioned generally at or near the vertical center of the slots 26 to permit generally equal vertical movement in an up or down direction. Separate fasteners 30 can be used to attach the drywall 18 to the stud 16. The uppermost fastener 30 is positioned at some point below the track 12 and, preferably, far enough below the lower end of the flange 24 to avoid limiting relative movement between the stud 16 and the track 12, but high enough to appropriately support the upper end of the drywall 18.

Each of the flanges 24 can comprise a first segment 32 and a second segment 34. Preferably, the first and second segments 32 define planar portions or are each substantially entirely planar. As illustrated in FIGS. 1 and 2, the second segments 34 can be recessed inwardly from the first segments 32, such that the cross-sectional distance between the first segments 32 is greater than the cross-sectional distance between the second segments 34. The distance is measured in a direction that is perpendicular to the flanges 24 and parallel to the web 22. In some embodiments, the second segments 34 can be recessed in by approximately ⅛ inch on each side of the track 12, though other recess depths are also possible. Preferably, the recess depth is sufficient to accommodate the head portion of the fastener 28 used to secure the stud 16 to the track 12. In some cases, the recess depth may be approximately ⅛ inch, approximately 3⁄16 inch, or approximately ¼ inch.

In some embodiments, the second segments 34 can have a greater height (i.e. height being in a direction generally perpendicular to the web 22) than the first segments 32. For example, in some embodiments, the first segments 32 can have a height of approximately 1¼", while the second segments 34 can have a height of approximately 2". Other heights and ranges of heights are also possible. The height of the first segment 32 preferably is equal to or at least slightly greater than the largest possible gap distance between an upper edge of the drywall 18 and the ceiling element 14 (generally determined by the slot 26 length or height). Thus, the drywall 18 can directly contact the first segment 32 to create a complete or at least a substantial seal between drywall 18 and the first segment 32 of the track 12, as described below. The height of the second segment 34 preferably is selected to provide a desirable amount of relative movement of the stud 16 relative to the track 12. Thus, preferably the height of the second segment 34 is related to and sufficient to accommodate a desired height of the slots 26.

The track 12 can further comprise at least one recess 36. The recess 36 can comprise, for example, an area or areas along the web 22 configured to received a strip or strips of fire-retardant material 20. The strip or strips of fire-retardant material 20 can be bonded to the track 12, for example by adhesion, along the recess 36. In order to inhibit or prevent fire and/or smoke from spreading through the wall joints, the strip or strips of fire-retardant material 20 can be compressed between two rigid surfaces. Keeping the material sandwiched, compressed, and/or contained between rigid surfaces can inhibit the spread of fire and/or smoke as the strip of fire-retardant material 20 expands within a wall joint. Without compression or containment of the fire-retardant material 20, the fire-retardant material 20 can potentially expand to a point where the strip of material 20 may fall away from the track 12, and/or can no longer substantially inhibit or prevent the spread of fire and/or smoke. Thus, in at least some of the embodiments described herein, at least one rigid surface can comprise the recess 36, and the other rigid surface can comprise the ceiling element 14. Moreover, prior to any expansion, or prior to complete expansion, of the fire-retardant material strips 20, the illustrated arrangement provides a complete or substantially complete seal between the track 12 and the ceiling element 12 at temperatures below the threshold to cause expansion of the fire-retardant material 20 and/or prior to complete expansion of the fire-retardant material 20. In addition, any of the header tracks 12 incorporating a fire-retardant material strip 20 illustrated herein can create a complete or substantial seal between the header track 12 and the ceiling element 14. Preferably, the seal created is sufficient to permit the wall system 10 to pass the UL 2079 test L-Rating.

With continued reference to FIGS. 1 and 2, the drywall 18 can have an end 38 flush with, and/or in contact with, first segment 32 of the track 12 when the drywall 18 is attached to the stud 16. For example, the drywall 18 can be attached to the stud 16 with a fastener or fasteners 30 at a location spaced below the flange 24. The recessed second segments 34, located below the first segments 32, can provide room for the heads of fasteners 28 to extend from the stud 16 and track 12, without substantially pressing against or deforming the drywall 18. In other words, the recessed second segments 34 create a space between the segment 34 and inner surface of the drywall 18 to accommodate the heads of the fasteners 28.

Figure 3:
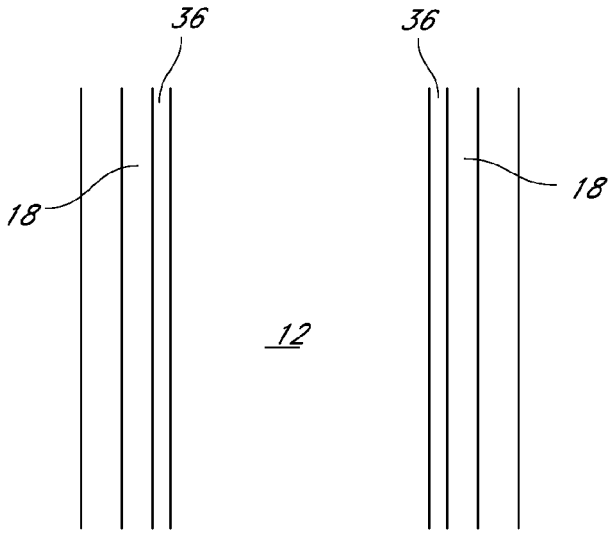
FIG. 3 illustrates a top plan view of the wall system of FIG. 1, without the fire-retardant material applied thereon.

With reference to the top view of the wall system 10 shown in FIG. 3, the drywall boards 18 can be pressed against the first segments 32 of track 12, thereby forming a seal between the drywall 18 and track 12. In FIG. 3, the strips of fire-retardant material 20 have been removed for clarity.

Figure 4:
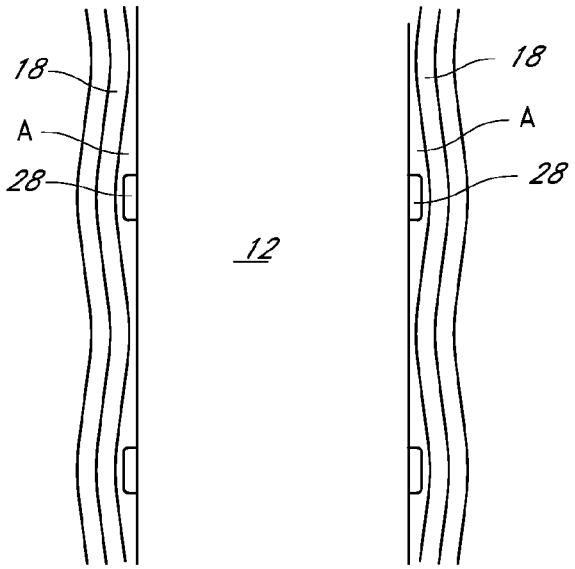
FIG. 4 illustrates a top plan view of a wall system in which the fastener heads of a stud fastener can create air gaps between the wallboard and header track when certain header tracks are employed.

With reference to FIG. 4, sometimes a track 12 may include no recessed second segments 34. Instead, the flanges of track 12 extend vertically down from the web, and the fasteners 28 are exposed outside the track 12. When the drywall 18 is attached to the track 12, the drywall 18 is forced to bend around the heads of fasteners 28, thereby forming undesirable gaps A between the drywall 18 and track 12 which can permit passage of fire and/or smoke. The track 12 shown for example in FIGS. 1, 2, and 3, can reduce or eliminate these gaps, permitting a seal between the drywall 18 and flange 24.

With continued reference to FIG. 1, and with reference to all the embodiments of the wall component systems 10 described herein, the wall component system 10 can include a backer rod 40 and at least one layer of acoustic sealant 42. The backer rod 40 can comprise, for example, a closed-cell foam strip of material placed adjacent the first segment 32. In some embodiments, the backer rod can comprise an open-cell tan Denver foam. Other materials for the backer rod 40 are also possible, including but not limited to rubber, metal or plastic. However, in preferred embodiments, the backer rod 40 is at least somewhat compressible to accommodate movement of the drywall 18 and shrinking of the head-of-wall gap.

In some embodiments, the fire-retardant material 20 can be adhesively bonded to the surface or surfaces of the recess 36. In those embodiments where the fire-retardant material has generally four sides when viewed at a cross-section, the fire-retardant material can be adhesively bonded to the track 12 along at least a portion of two of the four sides, such as shown in FIG. 1, and the other two sides can be in contact with the ceiling element 14 and be in contact with or facing the backer rod 40, respectively. In some embodiments, the fire-retardant material 20 can be bonded along only a single side, or along other numbers of sides. In some embodiments, the fire-retardant material can be unattached to the track 12. Instead, only the compressive force between for example the track 12 and the ceiling element 14 can hold the fire-retardant material 20 in place.

With continued reference to FIG. 1, the acoustic sealant 42 can comprise a USG acoustic sealant commonly used in the industry. The acoustic sealant 42 can be applied over and/or adjacent the backer rod 40, in an area between the top portion 38 of drywall 18 and the ceiling element 14. The acoustic sealant 42 can fill in gaps, for example, between the track 12 and drywall 18, and/or between the track 12 and ceiling element 14. Acoustic sealant 42 is generally less expensive, and more flexible, than fire-caulking and can be preferred for aesthetic reasons. Thus, acoustic sealant is generally the preferred material for use with the systems 10 described herein. However, in some embodiments, fire caulking, or other suitable material, can alternatively, or additionally, be used. In some embodiments, the system 10 can include only the fire-retardant material 20, as opposed to the fire-retardant material 20 combined with the backer rod 40 and/or acoustic sealant 42 (or other material).

With continued reference to FIG. 1, and again with reference to all the embodiments of the wall systems 10 described herein, when the wall system 10 is exposed to heat, the fire-retardant material 20 can expand, the acoustic sealant 42 can burn off, and the backer rod 40 can be pushed away (e.g. fall off) from the track 12 by the expanding fire-retardant material 20 (e.g. intumescent tape). If the fire-retardant material 20 is located adjacent the corners of the track 12, the fire-retardant material 20 can be held in place between the web 22 and ceiling element 14, and the fire-retardant material 20 can expand laterally outwards into an area between the ends or upper edges 38 of the drywall 18 and the ceiling element 14. Thus, the fire-retardant material 20 can seal off gaps between web 22 and ceiling element 14 and/or between track 12 and drywall 18. As illustrated in FIGS. 1 and 2, for example, in some embodiments a small portion of the fire-retardant material 20 can extend laterally outward past the edge of the flange 24 from a corner of the track 12. This can advantageously allow the material 20 to begin expanding down towards the drywall 18 immediately upon being exposed to elevated levels of heat. The edge of the fire-retardant material 20 can extend past the intersection of the web 22 and flange 24 or past the outer surface of the first segment 32 of the flange 24 by at least ⅛ inch, at least 3/16 inch or at least ¼ inch. It is contemplated that the upper corner strips 20 of FIGS. 5 and 6, FIGS. 7 and 8, FIGS. 9-11, and FIG. 17 may also extend outwardly beyond the corner or outermost surface of the flange 24. If desired, the fire-retardant material 20 can wrap around the corner, be secured to and also extend along a portion of the first segment 32 of the flange, as disclosed in U.S. Pat. No. 7,617,643 and U.S. Publication No. 2009/0049781, which are incorporated by reference herein in their entireties.

Figure 5:
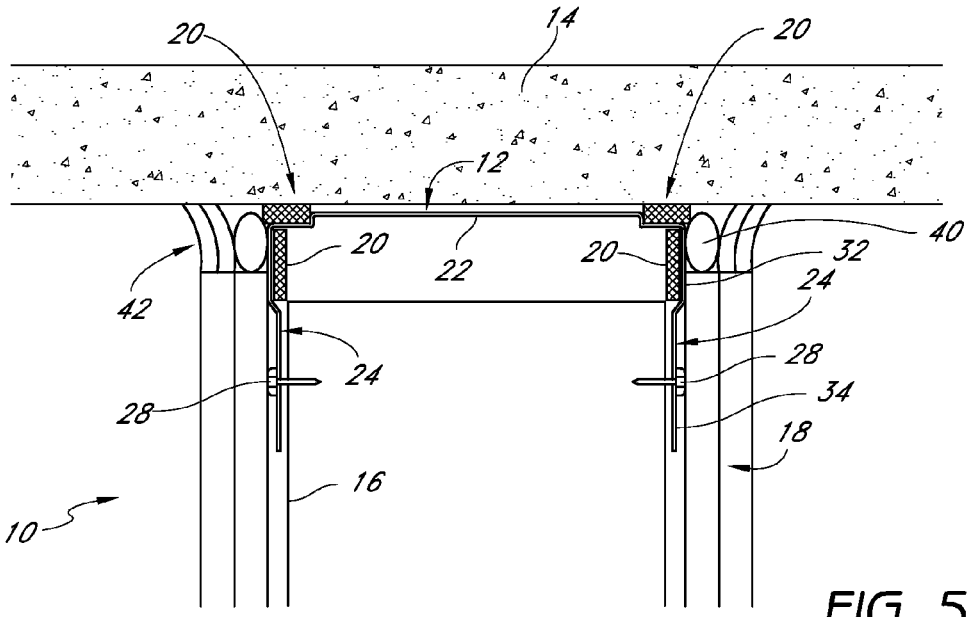
FIG. 5 illustrates a cross-sectional view of an embodiment of a wall system that incorporates a modified header track.
Figure 6:
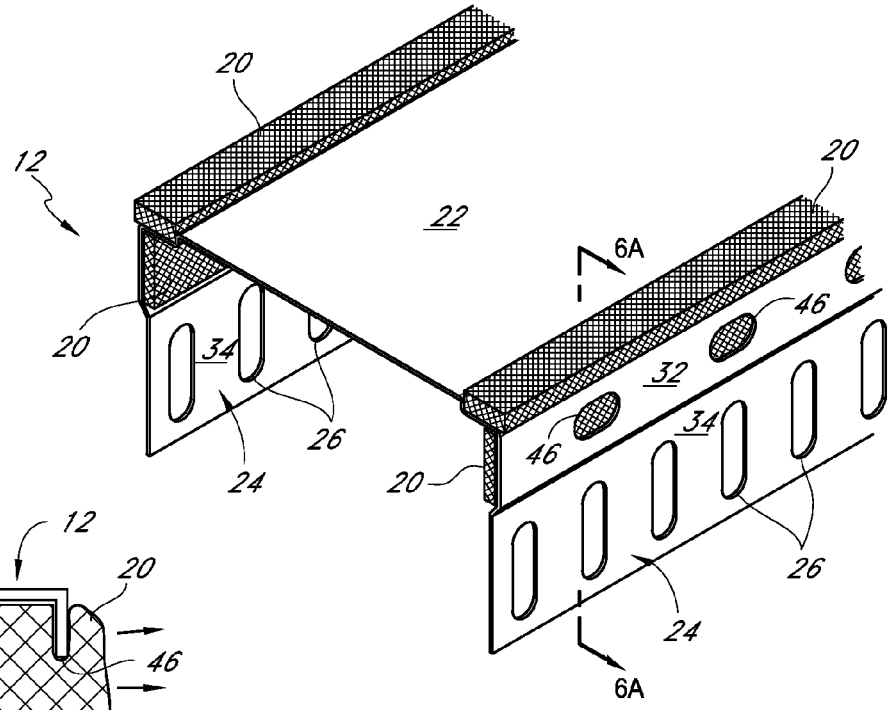
FIG. 6 illustrates a perspective view of the header track of the wall system of FIG. 5.
Figure 6A:
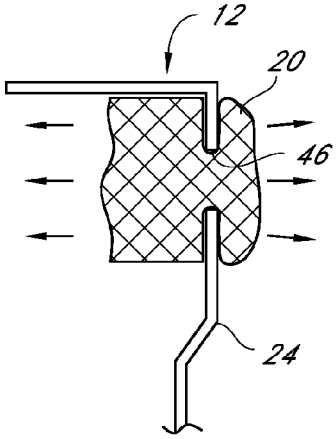
FIG. 6*a* illustrates an enlarged cross-sectional view of the header track of FIG. 6 taken along line 6A-6A of FIG. 6 with the fire-retardant material in an expanded condition.

FIGS. 5, 6 and 6A illustrate another embodiment of a wall system 10. The wall system of FIGS. 5, 6 and 6A is similar in many aspects to the wall system 10 described with reference to FIGS. 1 and 2. Accordingly, the same reference characters are used to refer to the same or similar components or features. In addition, the following description is primarily directed toward the differences between the system 10 of FIGS. 5, 6 and 6A and the system 10 of FIGS. 1 and 2. Therefore, unless otherwise noted, the components and features of the system of FIGS. 5, 6 and 6A not specifically described can be assumed to be the same or similar to the corresponding components or features in the system 10 of FIGS. 1 and 2.

Preferably, the track 12 of FIGS. 5, 6 and 6A includes fire-retardant material strips 20 positioned on inward-facing surfaces of the first segment 32 of at least one flange 24 and, in some arrangements, of both flanges 24. For example, in interior wall applications, in which the wall system 10 separates two interior spaces, it is desirable to have fire-retardant material 20 on each flange 24. For example, in exterior wall applications, only one flange 24 may be provided with fire-retardant material 20. Optionally, fire-retardant material 20 may be provided on other portions of the track 12, such as the exterior, upward-facing surfaces as shown and described in connection with FIGS. 1 and 2. In addition, fire-retardant material 20 may be positioned on other portions of the track 12 or other components of the wall system 10 as appropriate or desirable. In some embodiments, the fire-retardant material 20 may be provided on an exterior surface of the flange(s) 24, similar to the tracks 12 described in connection with FIGS. 7 and 8, 12 and 13, and 17.

Preferably, a thickness of the fire-retardant material strips 20 (prior to expansion) is substantially equal to or less than the linear distance or offset between the inward-facing surfaces of the first segment 32 and second segment 34 of the flange 24. Accordingly, the fire-retardant material 20 does not interfere with the vertical movement of the stud 16 and movement of the stud 16 is therefore unlikely to dislodge the fire-retardant material 20 from the track 12. The offset between the first segment 32 and second segment 34 preferably is also generally equal to or somewhat larger than a thickness of the head of the fastener 28. Thus, the thickness of the fire-retardant material 20 and the thickness of the head of the fastener 28 may be similar or generally equal in size.

The width of the fire-retardant material 20 (vertical dimension in FIG. 5) preferably is substantially equal or less than the length of the first segment 32 of the flange 24. However, in some arrangements, the fire-retardant material 20 can extend beyond the interior corner and also extend along a portion of the interior surface of the web 22 of the track 12. With any of the arrangements, and especially in those in which the fire-retardant material 20 is provided only on the interior of the track 12, preferably, a sufficient volume of fire-retardant material 20 is provided such that, upon expansion, a complete or substantially complete seal is created at the head-of-wall gap. Thus, preferably, the fire-retardant material 20 expands near, to or past the lower end of the slots 26 or lower edges of the flanges 24.

In some arrangements, it may be desirable to provide openings, slots or through-holes 46 (referred to collectively as openings 46) in any of a variety of shapes and sizes in the first segment 32 of the flange 24, or in another portion of the flange 24 or track 12 onto which the fire-retardant material 20 is placed or attached. For example, the openings 46 may be circular, oval, square, rectangular, triangular or other suitable shapes. Preferably, the number, size, shape and/or spacing of the openings 46 is/are selected such that the track 12 maintains sufficient strength, rigidity and durability to function as a top or bottom track despite the removal of material to create the openings 46. As illustrated in FIG. 6A, the provision of such openings 46 can permit the fire-retardant material 20 to expand through the opening to the other side of the flange 24. Advantageously, this can permit the fire-retardant material 20 to "key" onto the flange 24 and prevent dislodgement of the fire-retardant material 20 during expansion, thereby enhancing the reliability of the fire-blocking features of the wall system 10. In response to elevated heat, it is possible that the adhesive securing the fire-retardant material 20 to the track 12 will lose its ability to securely hold the fire-retardant material 20 to the track. In such instances, the fire-retardant material 20 could become dislodged prior to beginning to expand or prior to complete expansion. Advantageously, when the fire-retardant material 20 expands into the openings 46, it interacts with the surfaces of the track 12 to "key" itself to the track 12, or create a resistance to forces tending to dislodge the fire-retardant material 20. Thus, once expansion into the openings 46 occurs, the reliance on the adhesive retention of the fire-retardant material 20 is reduced or eliminated. Depending on the size, shape and/or collective area of the openings 46, the fire-retardant material 20 may be able to expand through the openings 46 to the outside of the track 12 to a sufficient degree to seal the head-of-wall gap between the top edge of the drywall 18 and the ceiling element 14. Thus, in some arrangements, significant expansion on both inside and outside of the track 12 may be accomplished. In some applications, the fire-retardant material 20 on the top of the web 22 may be omitted. Moreover, the provision of the fire-retardant material 20 on the inside of the track (and, preferably, within a recess) reduces the likelihood of damage to the fire-retardant material 20 during assembly of the wall system 10 and subsequent construction activities. However, as noted above, in other embodiments, the fire-retardant material 20 may be applied to an exterior surface of the track 12. Preferably, the exterior surface is on the flange 12 and, more preferably, the upper portion or first segment 32 of the flange 24. However, the fire-retardant material 20 may be positioned on other exterior surfaces of the track 12, including the web 22. One advantage of positioning the fire-retardant material 20 on an exterior surface of the track 12 results from the fact that the interior space of the wall 10 tends to rise in temperature more quickly that the space immediately adjacent an exterior surface of the wall 10, due to the heating of the top and bottom tracks, studs and other mass within the interior space of the wall 10. If the fire-retardant material 20 is positioned on the exterior surface of the track 12, it will tend to expand inwardly through the openings 46 thereby securing or keying itself to the track 12 prior to significant or substantial expansion of the fire-retardant material 20 outwardly away from the track 12. Advantageously, such an arrangement facilitates keying of the fire-retardant material 20 to the track 12 at least prior to complete expansion and, preferably, prior to significant or substantial expansion to increase the reliability of the fire-retardant material 20 in sealing of the associated wall joint or gap. Optional openings 46 are shown in the track 12 of FIG. 8 with the fire-retardant material or intumescent material 20 provided on an exterior surface of the track 12.

Figure 7:
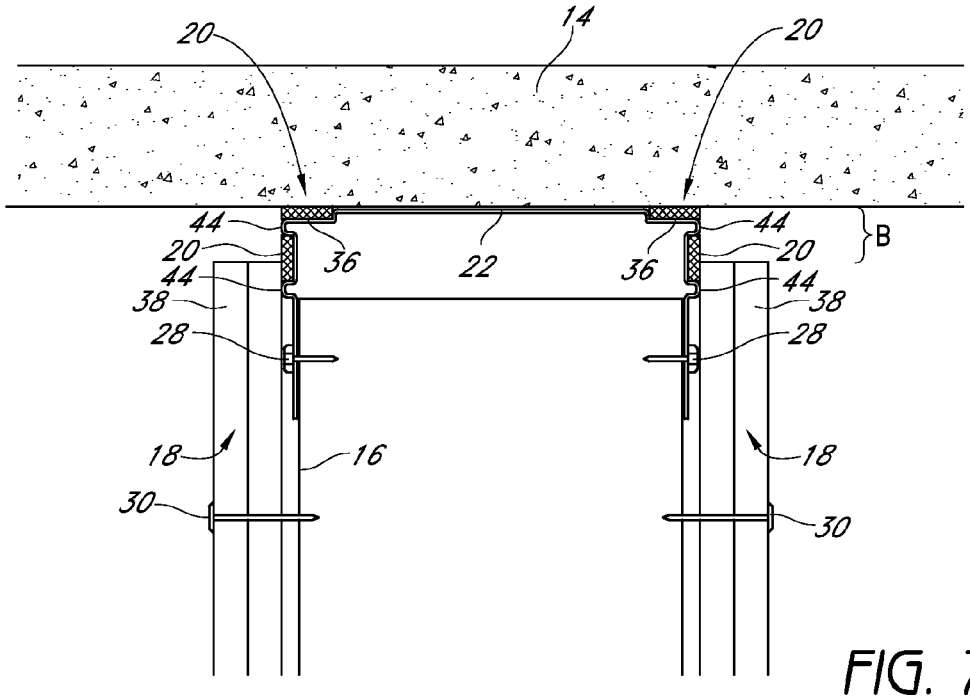
FIG. 7 illustrates a cross-sectional view of an embodiment of a fire-rated wall system, including a header track with fire-retardant material applied thereon.
Figure 8:
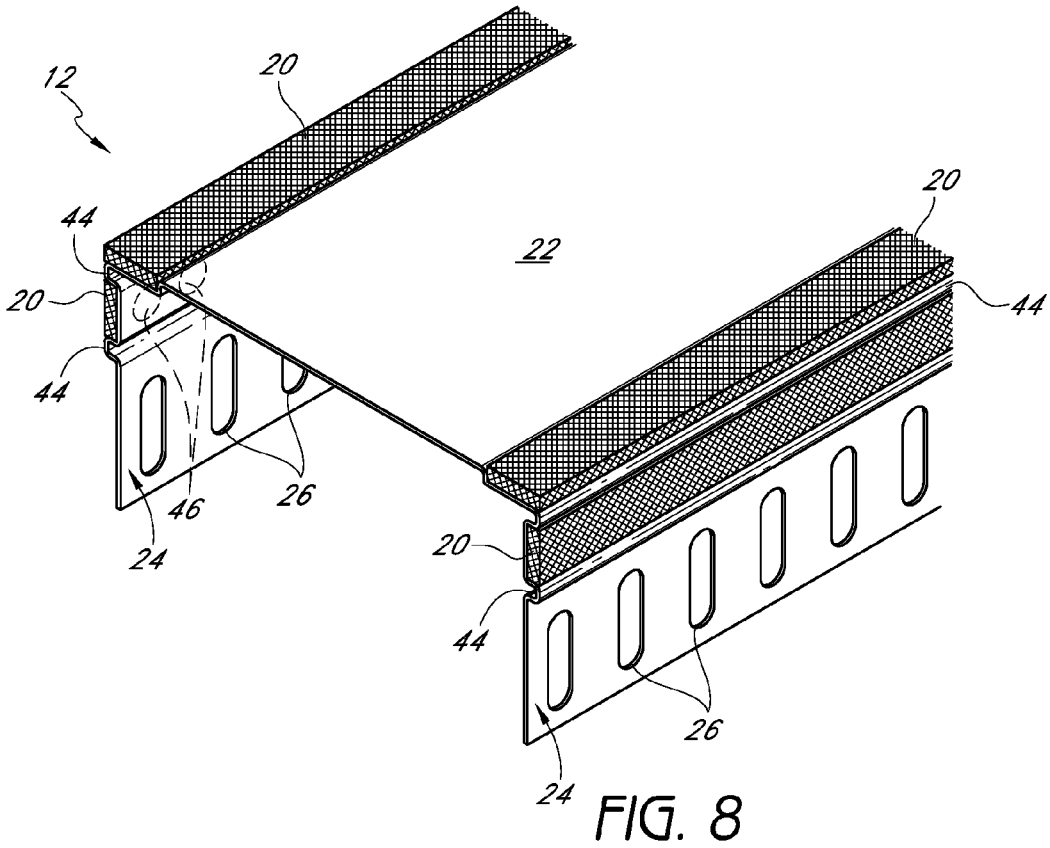
FIG. 8 illustrates a perspective view of the header track of FIG. 5 separate from the other components of the wall system.

With reference to FIGS. 7-11, additional embodiments of a track 12 can comprise a web 22 with at least one recess, such as upper web recess 36, and flanges 24. Rather than comprising only one strip of fire-retardant material 20 on each side of the track, as illustrated in FIGS. 1-3, the track 12 can alternatively comprise a plurality of strips of fire-retardant material 20 on each side of the track, as seen in FIGS. 7 and 8. For example, the track 12 can comprise a strip of fire-retardant material 20 adhered to each of the web recesses 36, as well as a strip of fire-retardant material 20 adhered to a portion of the flange 24. Alternatively, in some embodiments, the track 12 can comprise a single strip of fire retardant material 20 on either side of track 12 that extends along recess 36, and then further extends along at least a portion of the flange 24. In some embodiments, the strip of fire-retardant material 20 extending along the top of the web 22 can have a width (measured generally horizontally once installed) of approximately ½ inch, though other widths and ranges of widths are also possible. In some embodiments, the strip of fire-retardant material 20 extending along the flange 24 can have a height (measured generally vertically once installed) of approximately 1 inch, though other widths and ranges of widths are also possible. As disclosed in U.S. Pat. No. 7,617,642 and U.S. Publication No. 2009/0049781, it can be desirable to provide fire-retardant material 20 on both of the web 22 and flange 24 of the track 12. However, in some situations, it can be difficult to apply a single strip of fire-retardant material 20 material to a corner of a track 12 or difficult to maintain adherence to both the web 22 and flange 24 over a period of time. Thus, the embodiment of FIGS. 7 and 8 provides separate strips of fire-retardant material 20 to the web 22 and flange 24 to achieve a similar result with improved reliability over the life of the system 10.

With continued reference to FIGS. 7-11, in some embodiments the track 12 can comprise at least one elongate rib 44. The rib 44 can comprise, for example, a protrusion extending from the flange 24 and/or web 22. The ribs 44 can extend away from the stud 16, such that the ribs 44 provide support and/or resting locations for the drywall boards 18. As illustrated in FIGS. 7 and 8, for example, the drywall 18 can rest against the ribs 44 located along flange 24. Similar to the first segments 32 and second segments 34 described above, the ribs 44 can provide spaces for the heads of fasteners 28 below the ribs 44. The ribs 22 can permit a generally continuous seal between the drywall 18 and flanges 24, without causing the types of substantial gaps shown in FIG. 4.

With continued reference to FIG. 7, in some embodiments, the wall system 10 can comprise a head-of-wall gap B between the top ends 38 of the drywall 18 and the ceiling element 14. In some embodiments, this gap is approximately ¾ inch or more, though other sizes and ranges for the gap B are also possible. As illustrated in FIG. 7, this gap B can be sized such that the tops 38 of drywall 18 extend at least partially along strips of fire-retardant material 20. This configuration permits the drywall 18 to hold the fire-retardant material 20 in place, and assists in creating a seal between the track 12 and the drywall 18. During expansion of the fire-retardant material 20, the web strip and flange strip can intermix. As described, the web strip is pinched between the web 22 and ceiling element 22 and, advantageously, held in place during expansion to inhibit dislodgement of the fire-retardant material 20. The intermixing of the web strip and flange strip can inhibit dislodgment of the flange strip, as well. Thus, the provision of both the web strip and the flange strip is advantageous because the drywall 18 can be unreliable as the sole means for inhibiting dislodgement of the fire-retardant material 20 flange strip.

Figure 9:
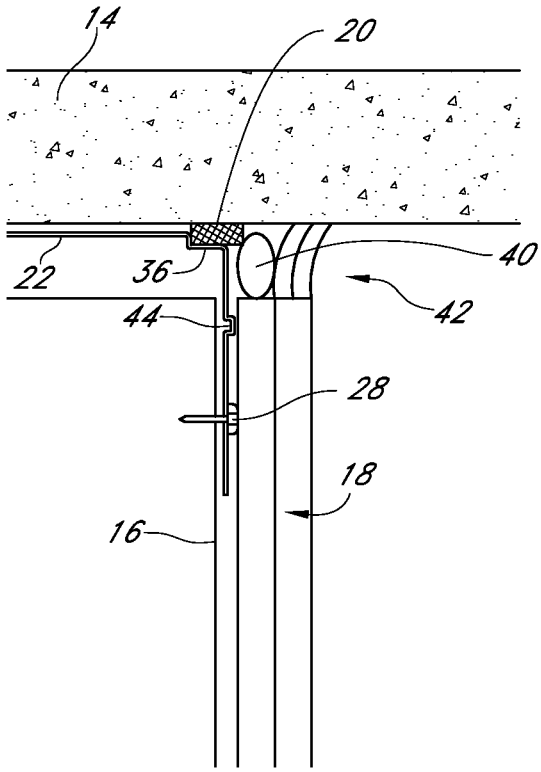
FIG. 9 illustrates a cross-sectional view of an embodiment of a fire-rated wall system, including a header track with fire-retardant material applied thereon.
Figure 10:
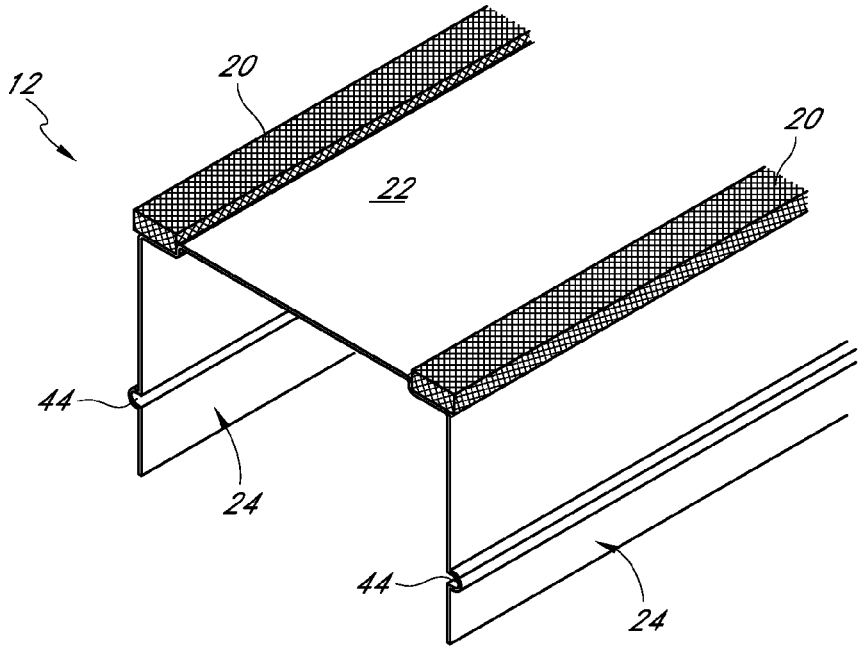
FIGS. 10 and 11 illustrate perspective views of embodiments of a fire-rated header track with fire-retardant material applied thereon.

FIGS. 9 and 10 illustrate an embodiment similar to the embodiment of FIGS. 7 and 8. However, in the embodiment of FIGS. 9 and 10, the flange strip of fire-retardant material 20 is omitted, as is the upper rib 44 on each flange 24. The lower rib 44 on each flange 24 preferably is still provided for sealing purposes. In addition, preferably, the fire-retardant material 20 extends beyond a corner or edge of the track 12, as described in connection with previous embodiments. Moreover, the illustrated track 12 in FIGS. 9 and 10 do not include slots in the flanges 24. In applications where relative movement is not needed or desired between the stud 16 and track 12, or if the studs 16 are not connected to the track 12 in the final assembly to permit movement, the track 12 can have no slots 26. Therefore, while some of the embodiments of the track 12 described herein are shown with slots 26 (FIG. 11), it is to be understood that such embodiments could alternatively have no slots 26.

Figure 11:
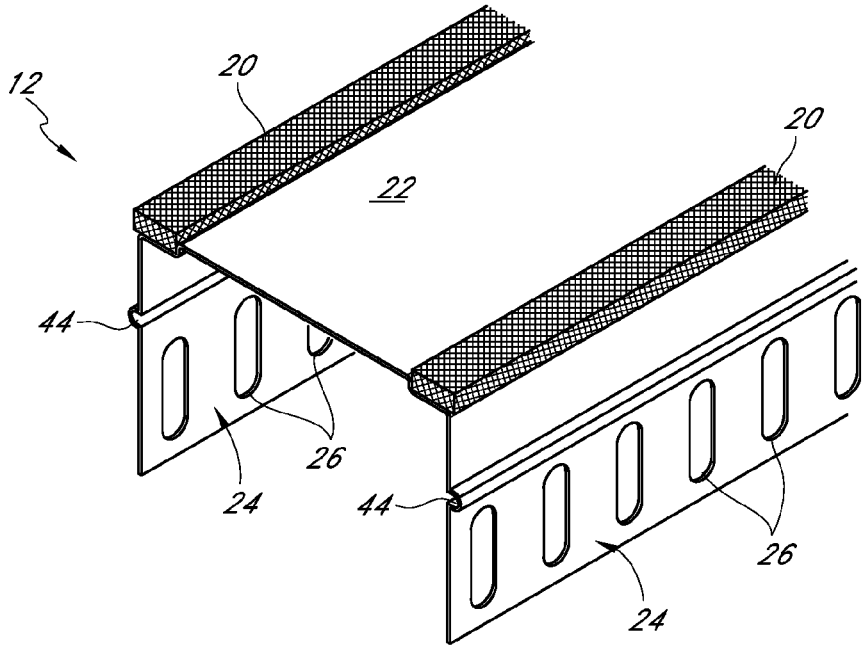

The embodiment of FIG. 11 illustrates a track 12 similar to that of FIGS. 9 and 10, but also including vertical slots in a lower section of the flanges 24, below the rib 44. Preferably, the fire-retardant material 20 also extends beyond an edge or corner of the track 12.

Figure 12:
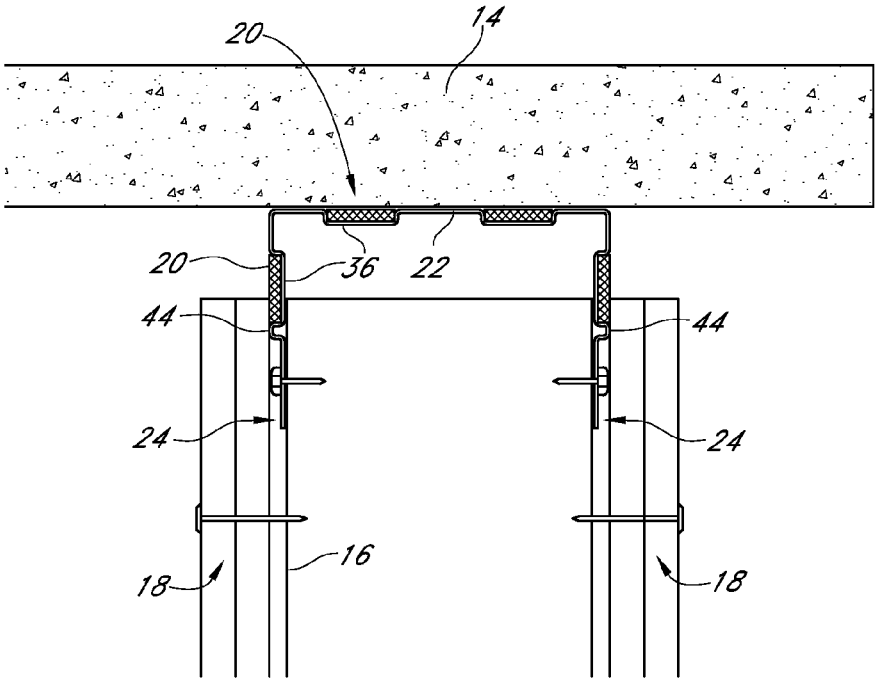
FIG. 12 illustrates a cross-sectional view of an embodiment of a fire-rated wall system, including a header track with fire-retardant material applied thereon.
Figure 13:
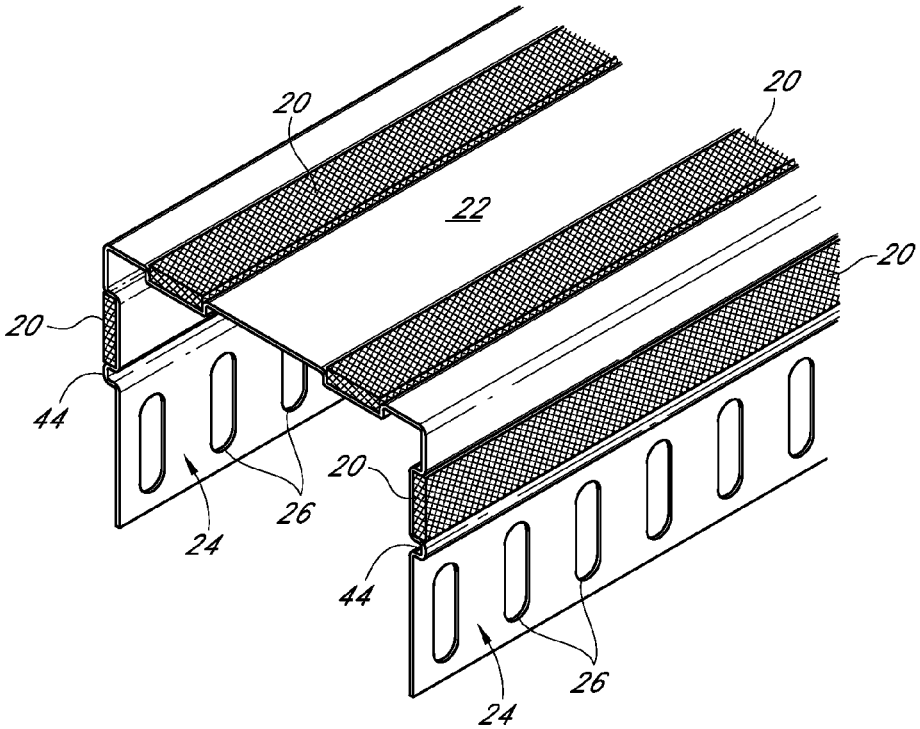
FIG. 13 illustrates a perspective view of an embodiment of the header track of FIG. 12 separated from the other components of the wall system.

With reference to FIGS. 12 and 13, and as described above, in some embodiments the track 12 can comprise multiple strips of fire-retardant material 20. The multiple strips of fire-retardant material 20 can be adhered to, or otherwise attached to, multiple recesses 36 along the web 22 and/or flanges 24. As illustrated in FIG. 12, for example, the track 12 can comprise two recesses 36 along the web 22, and one recess 36 along each of the two flanges 24. In some embodiments, a portion or portions of the fire-retardant material 20 (e.g. intumescent material), can extend partially outside of the recesses 36 (i.e. away from the stud 16) prior to installation. For example, the fire-retardant material 20 along the web 22 can extend slightly past the rest of web 22, and then be compressed when the web 22 is installed onto the ceiling element 14 to create or enhance the seal therebetween. Similarly, the fire-retardant material 20 along the flanges 24 can extend beyond the rib 44 (or other outermost surface of the track 12) and be compressed by the drywall 18 to create or enhance the seal therebetween. In addition, the fire-retardant material 20 on the web 22 may be spaced inwardly from the corners, as shown, or extend to or past the corners, as in previously-described embodiments.

As described above, the track 12 preferably includes ribs 44 adjacent the recesses 36 along the flanges 24. Advantageously, the ribs 44 can provide spaces sized to accommodate the heads of the fasteners 28 below the ribs 44. The ribs 44 can permit a generally continuous seal between the drywall 18 and flanges 24, without causing the types of substantial gaps shown in FIG. 4.

Figure 14:
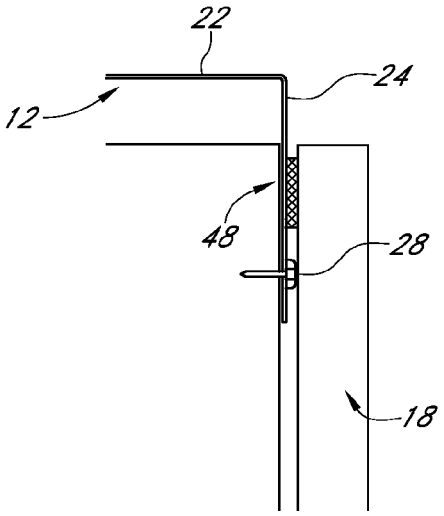
FIGS. 14 and 15 illustrate cross-sectional views of embodiments of a fire-rated wall system including seal structures that inhibit or at least substantially prevent air from passing between the wallboard and header track.

With reference to FIG. 14, in some embodiments a track 12 can comprise a generally flat web 22, and a generally straight, or vertical, flange 24 extending from the web 22 (e.g. at a right angle). A strip, such as a piece of tape 48, can be adhesively applied (or otherwise secured) to the flange 24. The tape 48 can be sandwiched between the flange 24 and drywall 18. The tape 48 can create an air seal. In some embodiments, tape 48 is a foam tape, rubber tape, plastic tape, and/or any other suitable tape. In some embodiments the tape 48 can be fire-retardant. Such an arrangement can be used alone, in combination with conventional head-of-wall gap sealing arrangements, or with other suitable arrangements described herein or in any of the documents incorporated by reference herein.

Figure 15:
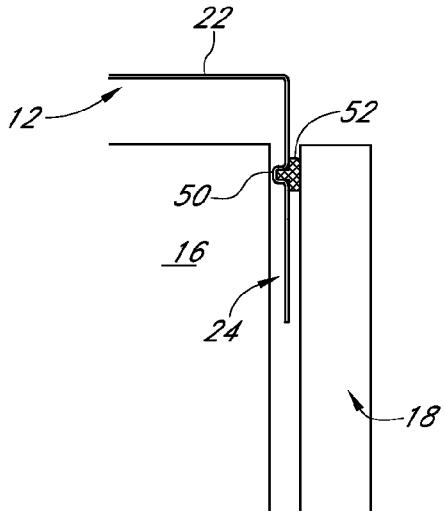
Figure 16:
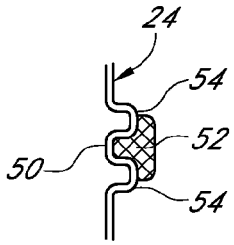
FIG. 16 illustrates a modified flange portion of a header track including a pair of elongated protrusions on opposite sides of a seal member, which preferably contacts adjacent wallboard to create at least a substantial seal between the flange and the wallboard.

With reference to FIGS. 15 and 16, in some embodiments the flange 24 can include a recess 50 along the flange 24 that is configured to receive a snap-in weather strip material 52. In some embodiments, the recess 50 can be surrounded by protrusions 54 (FIG. 16) to facilitate a snap fit. In some embodiments, the snap-in weather strip material 52 can comprise the tape 48 described above. In some embodiments the weather strip material 52 can be fire-retardant.

Figure 17:
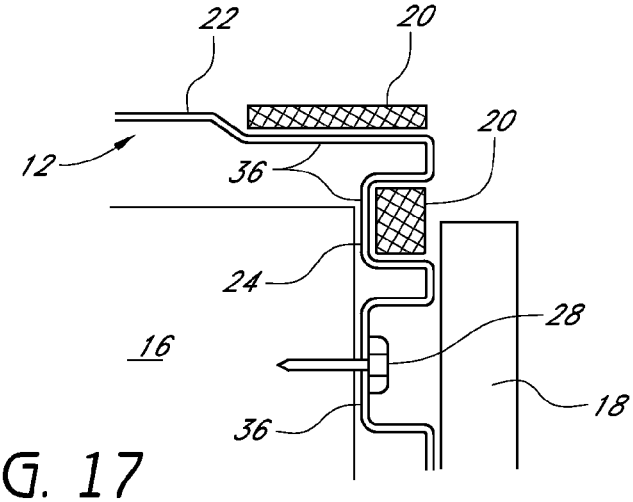
FIG. 17 illustrates a cross-sectional view of an embodiment of a fire-rated wall system including a header track with fire-retardant material applied thereon.

With reference to FIG. 17, in some embodiments a track 12 can comprise a web 22 that includes a recess 36. A piece or strip of fire-retardant material 20 can sit within recess 36 and can extend to or past the corner of the track 12, or extend short of the corner of the track. The track 12 can further comprise a flange 24 that includes two or more recesses 36 relative to an outermost surface (which may be defined by multiple, separated surface portions). A piece or strip of fire-retardant material 20 can sit within at least one of the recesses 36 along the flange 24. In some embodiments, a head of a fastener 28 can sit within one of the recesses 36 along the flange 24.

With reference to FIGS. 1-17, in some embodiments a wall assembly can comprise any of the tracks 12 described herein, a ceiling element 14 attached to the track 12, at least one piece of drywall 18 attached to the track 12, and at least one piece of fire-retardant material 20, tape 48 and/or weather-strip material 52 attached to a web 20 and/or flange 22 of the track 12. Additionally, in some embodiments, any wall assembly described herein can further comprise a backer rod 40, and at least one layer of acoustic sealant 42.

In those embodiments described herein wherein the flanges 24 are generally deep (e.g. where the flanges are longer in height than the web 22 is in width), the track 12 can temporarily be secured to the stud 16 with fasteners 28. Once the track 12 is in position around the stud 16 (i.e. when the stud 16 is nestled within the track 12), the fasteners 28 can be removed, and the drywall 18 can be attached to the stud 16. In some embodiments, a generally U-shaped track having long flanges 24, for example, can hold the stud 16 in place without use of fasteners 28 and permit relative vertical movement. In these embodiments, the track 12 can still incorporate the use of first and second segments 32, 34, ribs 44, or other components, for example, to facilitate alignment of the drywall 18 with the track 12, and to generally create a seal between the drywall 18 and the track 12.

Manufacturing

Metal stud manufactures can use traditional role forming technology to manufacture metal studs 16 and tracks 12 described herein. For example, long narrow widths of flat sheet steel can be fed through a series of rollers to produce a desired profile for a track 12. The profiles of the tracks 12 can be altered by changing the die that controls the rollers. It has been found that altering the tracks 12 to receive fire-retardant material 20 and adding the fire-retardant material 20 as illustrated for example in FIGS. 1-17, can inhibit air and smoke passage, and can satisfy the full requirements and recommendations of UL 2079.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present wall system, components and methods have been described in the context of particularly preferred embodiments, the skilled artisan will appreciate, in view of the present disclosure, that certain advantages, features and aspects of the system may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A fire-retardant wall system, comprising:

a horizontal ceiling element;

a plurality of vertical wall studs;

a header track for receiving the wall studs, the track connected to the horizontal ceiling element, the track comprising a web and at least one flange constructed from a unitary piece of metal, the flange extending from the web and having a first planar portion proximal the web and a second planar portion distal the web, the first planar portion having a first surface defined by the unitary piece of metal;

at least one surface on the web for accepting a fire-retardant material strip thereon;

at least a first fire-retardant material strip attached to the at least one surface on the web and configured to expand when exposed to elevated heat, the first fire-retardant material strip positioned between and contacting both the web and the horizontal ceiling element to create at least a substantial seal inhibiting the passage of air from one side of the track to the other side of the track through a gap between the horizontal ceiling element and the web when the fire-retardant material strip is in an unexpanded state;

at least one piece of wallboard supported by the wall studs, wherein the at least one piece of wallboard supported by the wall studs is in direct contact with the first surface of the first planar portion of the flange, and wherein the second planar portion of the flange is recessed inwardly from the first portion, such that the at least one piece of wallboard supported by the wall studs is not in direct contact with the second portion.

2. The wall system of claim 1, wherein the first fire-retardant material strip is positioned at a corner between the web and the at least one flange.

3. The wall system of claim 2, wherein the first fire-retardant material strip extends outwardly beyond the corner such that an outermost edge of the first fire-retardant material strip is spaced outwardly of the first planar portion of the at least one flange.

4. The wall system of claim 1, wherein the web defines a recess and the first fire-retardant material strip is positioned in the recess.

5. The wall system of claim 1, further comprising a plurality of fasteners, wherein each one of the plurality of fasteners attach one of the plurality of studs to the track, wherein the plurality of fasteners are located within the second planar portion of the at least one flange.

6. The wall system of claim 5, further comprising a plurality of vertical slots formed within the second planar portion and spaced along a length of the track, wherein each one of the plurality of fasteners is passed through one of the plurality of vertical slots.

7. The wall system of claim 1, further comprising a second fire-retardant material strip positioned on an interior surface of the first planar portion.

8. A fire retardant wall system, comprising:

a horizontal ceiling element;

a plurality of vertical wall studs;

a header track for receiving upper ends of the wall studs, the track connected to the horizontal ceiling element, the track comprising a web portion, a first flange and a second flange extending in the same direction from opposing side edges of the web portion the web portion and the flanges constructed from a unitary piece of metal, the header track defining an exterior surface and an interior surface, each of the first flange and the second flange having a planar proximal portion and a planar distal portion, the proximal portion being closer to the web than the distal portion and the distal portion containing a free end of a respective one of the first and second flanges, the proximal portion further having a first surface defined by the unitary piece of metal wherein a first distance is defined between the proximal portions of the first and second flanges and a second distance is defined between the distal portions of the first and second flanges, wherein the first and second distances are taken in a direction substantially parallel to the web and perpendicular to the side edges of the web, wherein the first distance is greater than the second distance, wherein the free ends of each of the first and second flanges define an opening that is equal to the second distance, at least one fire-retardant material strip secured to a surface of the header track;

at least one piece of wallboard supported by the wall studs, wherein the at least one piece of wallboard supported by the wall studs is in direct contact with the first surface of the proximal portion of one of the first and second flanges, and wherein the distal portion of the one of the first and second flanges is recessed inwardly from the proximal portion such that the at least one piece of wallboard supported by the studs is not in direct contact with the distal portion.

9. The wall system of claim 8, wherein the at least one fire-retardant material strip is secured to an interior surface of the proximal portion of one of the first and second flanges.

10. The wall system of claim 8, wherein the at least one fire-retardant material strip is secured to the web portion.

11. The wall system of claim 8, wherein the at least one fire-retardant material strip comprises a first strip and a second strip, wherein the first strip is secured to an interior surface of the proximal portion of one of the first and second flanges and the second strip is secured to the web portion.

12. A track adapted for use in a fire-retardant wall system, comprising a web portion, a first flange and a second flange extending in the same direction from opposing side edges of the web portion and spaced from one another a sufficient distance to receive an end of a wall stud therebetween, the track defining an exterior surface and an interior surface, at least one of the web portion, first flange and second flange comprising a plurality of openings extending therethrough, at least one fire-retardant material strip secured to the interior surface of the track such that it covers at least a portion of each of the plurality of openings.

13. The track of claim 12, wherein the at least one fire-retardant material strip covers an entirety of each of the plurality of openings.

14. The track of claim 12, wherein the plurality of openings and the at least one fire-retardant material strip are provided on one of the first and second flanges.

15. The track of claim 12 wherein at least one of the web portion, the first flange and the second flange further comprise a plurality of fastener slots extending therethrough such that the at least one fire-retardant material strip does not cover the fastener slots.

* * * * *